US007837161B2

(12) United States Patent
Chase

(10) Patent No.: US 7,837,161 B2
(45) Date of Patent: Nov. 23, 2010

(54) FURNITURE-FOOT ASSEMBLIES

(75) Inventor: John Chase, Rochester, MI (US)

(73) Assignee: Hiwatt Products, LLC, Rochester, MI (US)

( * ) Notice: Subject to any disclaimer, the term of this patent is extended or adjusted under 35 U.S.C. 154(b) by 0 days.

(21) Appl. No.: 12/358,407

(22) Filed: Jan. 23, 2009

(65) Prior Publication Data

US 2010/0187399 A1 Jul. 29, 2010

(51) Int. Cl.
*A47B 91/00* (2006.01)

(52) U.S. Cl. ..... 248/188.9; 16/42 T

(58) Field of Classification Search ..... 248/188.7, 248/188.9, 345.1; 16/42 R, 42 T; 297/448.2
See application file for complete search history.

(56) References Cited

U.S. PATENT DOCUMENTS

| | | | | | |
|---|---|---|---|---|---|
| D33,589 | S | | 11/1900 | Higgins | D8/107 |
| 807,535 | A | * | 12/1905 | Beardsley et al. | 248/188.9 |
| 870,770 | A | | 11/1907 | Fuller | |
| 934,005 | A | | 9/1909 | Neuberth | 16/30 |
| D44,996 | S | | 12/1913 | Buser | D8/374 |
| 1,389,572 | A | | 9/1921 | Berg | 248/188.4 |
| 1,604,293 | A | | 10/1926 | Lehmann | 16/42 R |
| 1,903,609 | A | | 4/1933 | Uhl | 16/42 R |
| 1,915,272 | A | | 6/1933 | Duncan, Jr. | 248/188.9 |
| 1,921,561 | A | | 8/1933 | Christmas | 248/188.9 |
| 2,457,723 | A | | 12/1948 | Pura | 16/32 |
| 2,546,492 | A | | 3/1951 | Booth | 248/188.8 |
| D167,876 | S | | 9/1952 | Auer | D8/374 |
| 2,637,063 | A | | 5/1953 | Becker | 16/42 R |
| 2,641,016 | A | | 6/1953 | Kramcsak, Jr. | 16/39 |
| 2,644,978 | A | | 7/1953 | Becker | 16/42 |
| 2,662,778 | A | * | 12/1953 | Ristow | 280/47.33 |
| 2,687,547 | A | | 8/1954 | Matter | 16/30 |
| D173,835 | S | | 1/1955 | Chapman et al. | D8/374 |
| 2,736,130 | A | * | 2/1956 | Boiu | 248/188.9 |
| 2,738,541 | A | | 3/1956 | Thornsbury | 16/42 R |
| 2,875,552 | A | | 3/1959 | Stillman | 248/188.9 |
| 2,902,794 | A | | 9/1959 | Ehrgott | 248/188.9 |
| 3,000,042 | A | | 9/1961 | Reynolds | 16/42 R |
| 3,191,213 | A | | 6/1965 | Congdon | 16/42 R |
| 3,342,445 | A | * | 9/1967 | Bouwkamp | 248/188.9 |
| 3,363,280 | A | | 1/1968 | LeVasseur | 16/42 R |
| 3,389,421 | A | | 6/1968 | Wheeler | 16/42 R |

(Continued)

FOREIGN PATENT DOCUMENTS

DE 40 30 557 C1 9/1991

OTHER PUBLICATIONS

Sep. 16, 2005 Office Action in connection with U.S. Appl. No. 10/941,162, filed Sep. 15, 2004.

(Continued)

*Primary Examiner*—Korie H. Chan
(74) *Attorney, Agent, or Firm*—Brooks Kushman P.C.

(57) ABSTRACT

A foot assembly is adapted to be removably attached to the elbow of a sled-type leg of a piece of furniture that is adapted to be supported upon a surface. The furniture-foot assembly includes a body defining a hollow interior adapted to removably receive the elbow of the leg and a bottom exterior portion. A glide is adapted to be removably mounted to the bottom exterior portion of the body and supported upon the surface for gliding movement of the furniture-foot assembly relative to the surface.

8 Claims, 2 Drawing Sheets

U.S. PATENT DOCUMENTS

| | | | | |
|---|---|---|---|---|
| 3,528,635 | A * | 9/1970 | Nightingale | 248/188.9 |
| 3,641,620 | A | 2/1972 | Hage | 16/19 |
| 3,722,026 | A | 3/1973 | Wilhelmi | 16/42 T |
| 4,635,305 | A * | 1/1987 | Wyss | 5/99.1 |
| 4,731,901 | A | 3/1988 | Daniels | 16/42 R |
| 4,754,714 | A | 7/1988 | Drumm | 108/157.18 |
| 5,081,740 | A | 1/1992 | Smith | 16/42 R |
| 5,191,676 | A | 3/1993 | Gerner | 16/42 |
| D336,205 | S | 6/1993 | Cooper | D7/624.1 |
| 5,220,705 | A | 6/1993 | Bushey | 16/42 R |
| D340,638 | S | 10/1993 | Campbell | D8/374 |
| 5,426,818 | A | 6/1995 | Bushey | 16/42 R |
| D376,753 | S | 12/1996 | Nakamura | D8/374 |
| D383,377 | S | 9/1997 | Sellers | D8/374 |
| 5,749,121 | A * | 5/1998 | Loescher | 16/43 |
| 6,324,725 | B1 | 12/2001 | Green | 16/42 T |
| 6,354,231 | B1 | 3/2002 | Morris | 108/144.11 |
| 6,385,814 | B1 * | 5/2002 | Krumwiede | 16/42 R |
| 6,405,982 | B2 | 6/2002 | Ferencz | 248/188.9 |
| 6,471,622 | B1 | 10/2002 | Hammer et al. | 482/54 |
| 6,623,082 | B1 * | 9/2003 | Huang | 248/188.9 |
| 6,626,405 | B1 | 9/2003 | Keast et al. | 248/188.9 |
| D487,392 | S | 3/2004 | Chase | D8/374 |
| 6,719,256 | B2 | 4/2004 | Rydell et al. | 248/346.11 |
| 6,754,934 | B1 | 6/2004 | Shiffler | 16/42 R |
| 6,883,763 | B2 | 4/2005 | Bosman et al. | 248/188.9 |
| 7,380,879 | B2 * | 6/2008 | Fletcher et al. | 297/270.1 |
| 2003/0163894 | A1 * | 9/2003 | Jones et al. | 16/42 R |
| 2006/0053586 | A1 | 3/2006 | Chase | 16/42 R |
| 2006/0053587 | A1 | 3/2006 | Chase | 16/42 R |

OTHER PUBLICATIONS

Nov. 2, 2005 Final Office Action in connection with U.S. Appl. No. 10/941,162, filed Sep. 15, 2004.

Mar. 14, 2006 Office Action in connection with U.S. Appl. No. 10/941,162, filed Sep. 15, 2004.

May 1, 2006 Final Office Action in connection with U.S. Appl. No. 10/941,162, filed Sep. 15, 2004.

Oct. 10, 2006 Office Action in connection with U.S. Appl. No. 10/941,162, filed Sep. 15, 2004.

* cited by examiner

FURNITURE-FOOT ASSEMBLIES

BACKGROUND OF THE INVENTION

1. Field of the Invention

The present invention relates, in general, to a foot attachable to a leg of a piece of furniture and, in particular, to foot assemblies removably attachable respectively to the elbow and free end of each sled-type leg of a chair or desk.

2. Description of the Related Art

The free end of each leg of a piece of furniture often includes a cap, foot, glide, or the like. In many institutionalized settings, such as in a school or other educational facility, the foot disposed on the corresponding free ends of the respective legs of a piece of furniture are designed to allow easy sliding of a chair or desk, for instance, upon a surface such as a floor. More specifically, the foot is designed to increase the amount of surface-area contact, but reduce the amount of frictional contact, between the legs and the floor.

One type of chair commonly employed in schools generally includes a pair of opposed, identical sled-type legs. Each such leg has an uppermost portion extending vertically or obliquely from a bottom surface of a seat of the chair toward a surface of a floor upon which the chair is supported. Each leg has also a lowermost portion extending horizontally and adapted to be supported upon the floor surface. Alternatively, the chair includes a single sled-type leg having a cross-member attached to and extending across the bottom surface of the seat of the chair. The uppermost portions integrally extend vertically or obliquely from respective ends of the cross-member toward the floor surface. The leg has also a pair of opposed, identical lowermost portions extending horizontally and adapted to be supported upon the floor surface. In each case, corresponding uppermost and lowermost portions are integrally attached to each other at an elbow of the leg.

However, these legs suffer from many disadvantages. More specifically, use of this type of leg generally facilitates a sliding motion across a relatively large surface area of the floor and, therefore, increases incidence and coverage of floor scraping, scratching, or marring and attendant noise. This relatively greater amount of scraping, scratching, or marring, in turn, increases not only costs of stripping, waxing, and buffing the floor and other labor and material costs associated with maintaining the floor, but also the number of airborne particulates and, thus, pollutants in the room in which the corresponding chair or desk is used. Furthermore, the bottom surface defines relatively more area upon which dirt, dust, sand, and other debris can gather, thus making this type of leg relatively more difficult, time-consuming, and, thus, expensive to clean and keep sanitary. This debris can even be imbedded into the bottom surface of the leg such that the texture of the bottom surface becomes like sandpaper and, thus, scrapes, scratches, or mars the floor even more than it does otherwise.

In addition, when the chair or desk is moved along the floor, the frictional contact between this type of leg and the floor produces a perceptible, often irritating, noise. In a classroom setting, especially in an elementary school where there are a substantial number of relatively young students moving or "scooting" their respective chairs and desks at any one time, this noise can be multiplied to a very significant level.

Moreover, the floor upon which the corresponding chair or desk is supported can be mopped weekly, even daily. In such an especially wet environment, this type of leg—being made mostly or even entirely of metal—can rust and, hence, have a relatively shorter life, produce rust marks on the floor when the chair or desk is moved along the floor, and cause the legs of the chair or desk to be aesthetically displeasing.

Thus, there is a need in the related art for a relatively easy, efficient, and inexpensive way of adding foot respectively to the elbow and free end of a sled-type leg of a chair or desk. There is also a need in the related art for a glide that is adapted to be mounted to such a foot and reduce incidence of floor scraping, scratching, or marring and generation of noise. There is also a need in the related art for such a glide having a bottom surface that defines relatively less area upon which dirt, dust, sand, and other debris can gather. There is also a need in the related art for such a glide that may be replaced without replacing the entire corresponding foot.

SUMMARY OF THE INVENTION

The present invention overcomes the disadvantages in the related art in a foot assembly adapted to be removably attached to the elbow of a sled-type leg of a piece of furniture that is adapted to be supported upon a surface. The furniture-foot assembly includes a body defining a hollow interior adapted to removably receive the elbow of the leg and a bottom exterior portion. A glide is adapted to be removably mounted to the bottom exterior portion of the body and supported upon the surface for gliding movement of the furniture-foot assembly relative to the surface.

One advantage of the furniture-foot assembly of the present invention is that use thereof is a relatively easy, efficient, and inexpensive way of adding a foot to the elbow of a sled-type leg of a chair or desk.

Another advantage of the furniture-foot assembly of the present invention is that it has a glide adapted to be removably mounted to the remainder of the assembly and reduce incidence of floor scraping, scratching, or marring and generation of noise.

Another advantage of the furniture-foot assembly of the present invention is that the bottom surface of the glide defines relatively less area upon which dirt, dust, sand, and other debris can gather.

Another advantage of the furniture-foot assembly of the present invention is that the glide may be replaced without replacing the remainder of the assembly.

Other objects, features, and advantages of the present invention are readily appreciated as the same becomes better understood while reading the subsequent description taken in conjunction with the accompanying drawings.

BRIEF DESCRIPTION OF EACH FIGURE OF THE DRAWINGS

DETAILED DESCRIPTION OF EMBODIMENTS OF THE INVENTION

Referring now to the figures, where like numerals are used to designate like structure, first and second furniture-foot assemblies of the present invention are generally indicated respectively at 10, 110. Whereas the foot assembly 10 is adapted to be removably attached to the elbow of a sled-type leg of a piece of furniture (such as a chair), generally indicated at 12, that is adapted to be supported upon a surface of, say, a floor 14, the foot assembly 110 is adapted to be removably attached to the free end of the sled-type leg.

Figure 1:
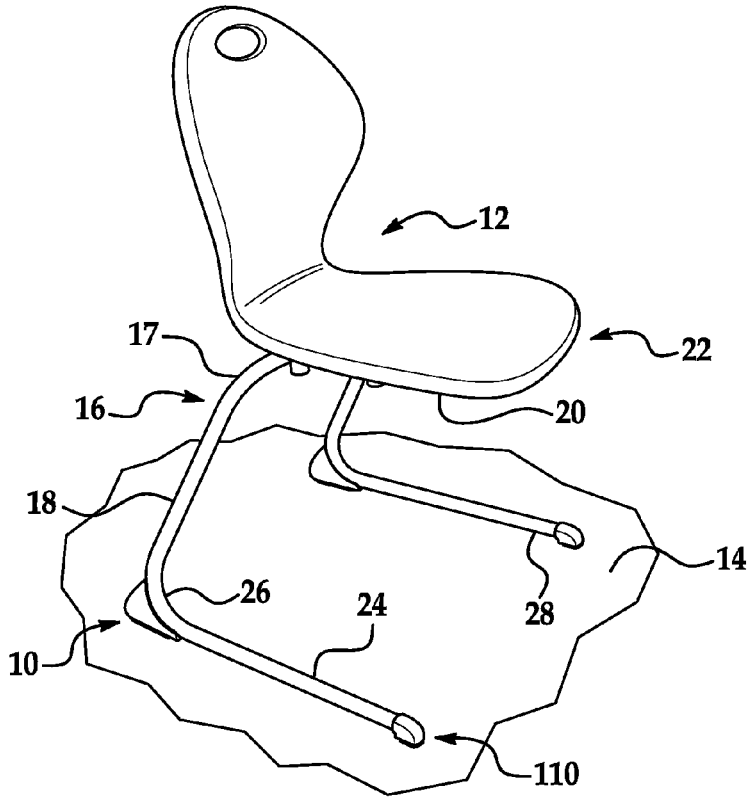
FIG. 1 is an environmental view showing furniture-foot assemblies of the present invention attached respectively to an elbow and free end of each of two sled-type legs of a chair that is supported upon a floor.

As shown in FIG. 1, a sled-type leg, generally indicated at 16, includes, in general, a cross-member 17 attached to and extending across a bottom surface 20 of a seat, generally indicated at 22, of the chair 12. The leg 16 also includes opposed, identical uppermost portions 18 integrally extending vertically from respective ends of the cross-member 17 toward the floor surface 14. The leg 16 also includes a pair of opposed, identical lowermost portions 24 extending horizontally and adapted to be supported upon the floor surface 14. The pair of corresponding uppermost and lowermost portions 18, 24 are integrally attached to each other at respective elbows 26 of the leg 16.

It should be appreciated by those having ordinary skill in the related art that the assemblies 10, 110 can be used in connection with a chair that is free-standing or combined with, say, a desk. It should also be appreciated that the assemblies 10, 110 can be used in connection with any suitable piece of furniture. It should also be appreciated that the assemblies 10, 110 can find special application when they are used in connection with chairs and desks of the type commonly employed in institutions, such as schools. However, it should also be appreciated that the assemblies 10, 110 are in no way limited to use in this fashion.

Figure 2:
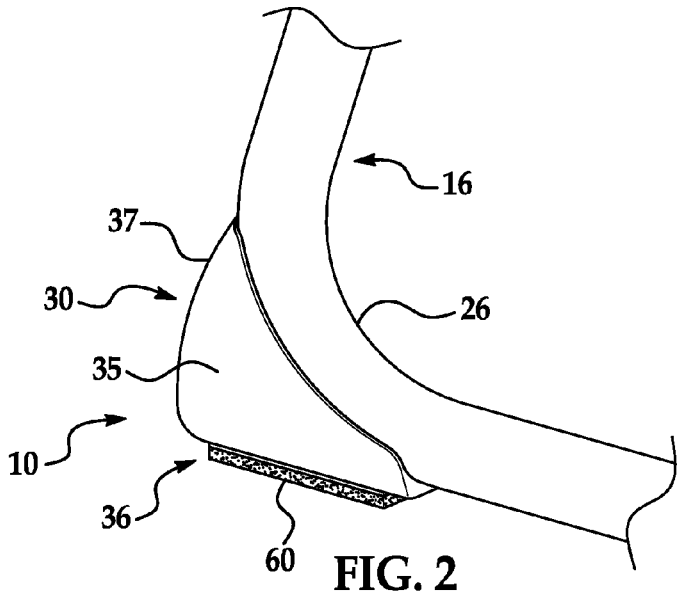
FIG. 2 is a perspective assembled view of one embodiment of a first furniture-foot assembly of the present invention.
Figure 3:
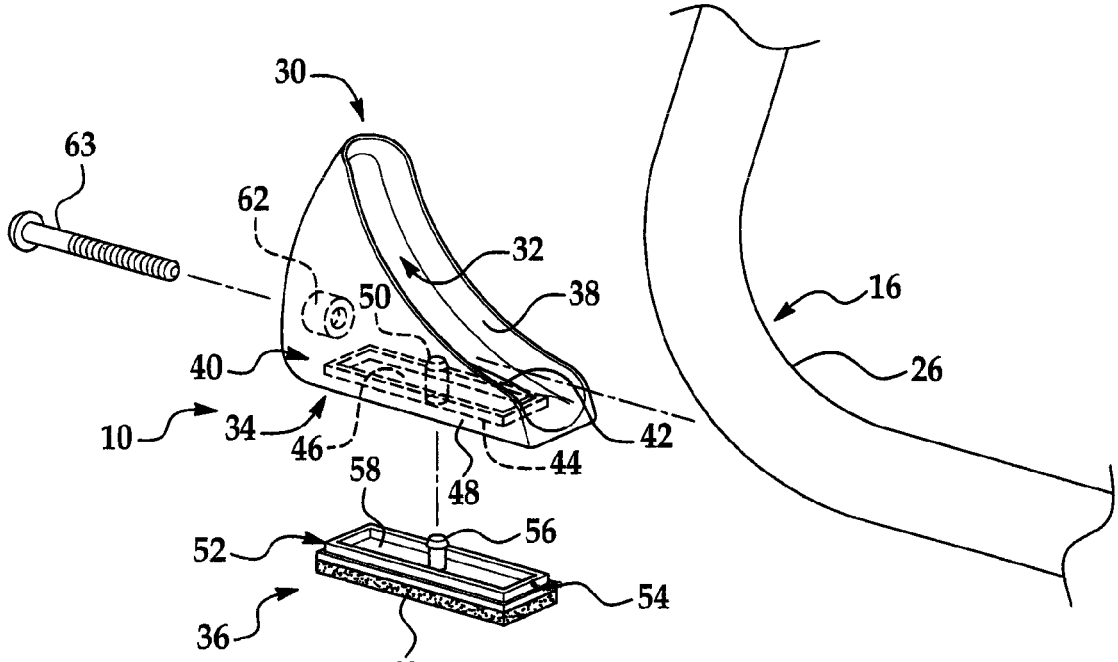
FIG. 3 is an assembly view showing the embodiment of the first furniture-foot assembly of the present invention illustrated in FIG. 2 being attached to the elbow of a sled-type leg of the chair and showing the glide being mounted to the body thereof.

Referring now to FIGS. 2 and 3, the furniture-foot assembly 10 includes, in general, a body, generally indicated at 30, defining a hollow interior, generally indicated at 32, that is adapted to removably receive the elbow 26 of the leg 16 and a bottom exterior portion, generally indicated at 34. A glide, generally indicated at 36, is adapted to be removably mounted to the bottom exterior portion 34 of the body 30 and supported upon the floor surface 14 for gliding movement of the assembly 10 relative to the floor surface 14.

More specifically, the body 30 defines further an exterior, generally indicated at 40. The shape defined by an outline of the interior 32 and exterior 40 of the body 30 conforms substantially to a shape defined by an outline of the elbow 26 of the leg 16. In particular, the body 30 defines a pair of substantially triangular faces 35 that are disposed opposite and identical relative to each other and a substantially arcuate, rectangular closed side 37 that is disposed between and integral with the faces 35. The body 30 also defines an open side 38 that is disposed adjacent to the closed side 37 and through which the elbow 26 of the leg 16 passes as the elbow 26 is matingly received within the hollow interior 32 of the body 30. The bottom exterior portion 34 is disposed between and integral with the faces 35 and adjacent to the closed and open sides 37, 38. The bottom exterior portion 34 is disposed also opposite an apex that connects the closed side 37 to the open side 38. In this way, the body 30 defines a single-open-sided housing of the elbow 26. The corner that connects the closed side 37 to the bottom exterior portion 34 is arcuate. A substantially uniform, linear rib 42 extends along substantially the entirety of a substantially central length of a bottom interior portion of the body 30 and is adapted to provide structural integrity to the body 30 vis-à-vis the leg 16 of the chair 12.

The bottom exterior portion 34 of the body 30 defines a groove 44 into which the glide 36 is adapted to be received to removably mount the glide 36 to the bottom exterior portion 34. In one embodiment, the groove 44 is substantially uniform and rectangular and outlines a substantially uniform and rectangular island 46 of the bottom exterior portion 34. The groove 44 extends a substantial length and width of the bottom exterior portion 34. The bottom exterior portion 34 also defines a substantially uniform ledge 48 that circumscribes substantially the entire groove 44 and is adapted to support a portion of the glide 36. A substantially central area of the island 46 defines an orifice 50 into which a portion of the glide 36 is adapted to be received to removably mount the glide 36 to the bottom exterior portion 34. The function of each of the ledge 48 and orifice 50 is described in greater detail immediately below.

The glide 36 has a substantially rectangular cap, generally indicated at 52, that is adapted to be received within the groove 44 of the bottom exterior portion 34 of the body. The cap 52, in turn, defines a rib 54 that limits movement of the glide 36 and is received within the groove 44. The cap 52 also defines a nub 56 that extends from an interior surface of the cap 52 and is adapted to be operatively matingly received within the orifice 50 of the bottom exterior portion 34 of the body 30 to removably mount the glide 36 to the bottom exterior portion 34. The cap 52 also defines a hollow interior 58 that is adapted to operatively receive the island 46 of the bottom exterior portion 34 of the body 30.

The glide 36 also includes a pad 60 adapted to be supported upon the floor surface 14 for gliding movement of the glide 36 and, thus, assembly 10 relative to the floor surface 14. In one embodiment, the pad 60 covers the surface of the cap 52 that is disposed opposite the interior 58 of the cap 52. The pad 60 may be made of any suitable material, but in the embodiment disclosed herein, the pad 60 is made of felt or a felt-like material.

The assembly 10 is mechanically fastened to the elbow 26 of the leg 16. In one embodiment, the closed side 37 of the body 30 defines a hole 62 of the body 30 that is adapted to receive a fastener, such as a screw 63, to fasten the body 30 to the elbow 26 of the leg 16.

It should be appreciated by those having ordinary skill in the related art that the body 30 can have any suitable shape, size, and structure and structural relationship with the leg 16. It should also be appreciated that the glide 36 can have any suitable shape, size, and structure and structural relationship with the body 36 and floor surface 14. It should also be appreciated that each of the cap 52 and pad 60 can have any suitable shape, size, and structure and structural relationship with the other. It should also be appreciated that the glide 36 can include any suitable material, such as rubber or nylon, adapted to be supported upon the floor surface 14 for gliding movement of the glide 36 and, thus, assembly 10 relative to the floor surface 14. It should also be appreciated that the assembly 10 can be mechanically fastened to the elbow 26 of the leg 16 by any suitable means.

Figure 4:
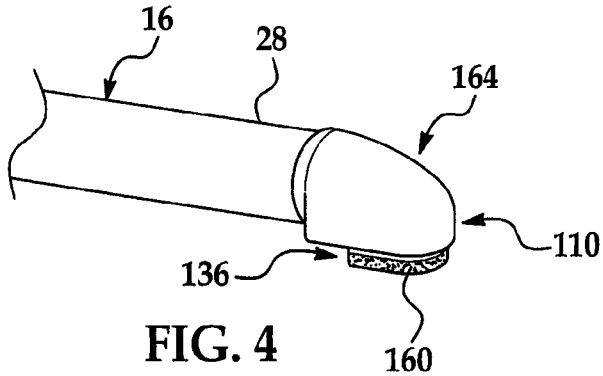
FIG. 4 is a perspective assembled view of one embodiment of a second furniture-foot assembly of the present invention.
Figure 5:
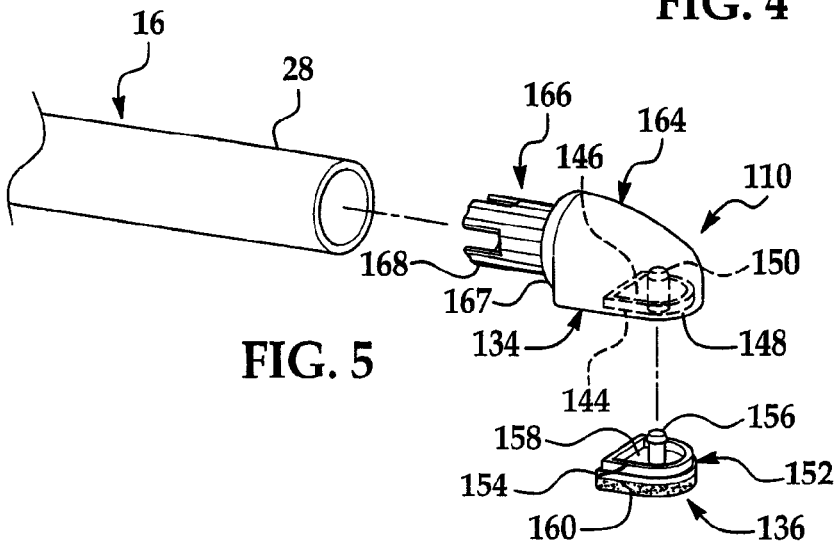
FIG. 5 is an assembly view showing the embodiment of the second furniture-foot assembly of the present invention illustrated in FIG. 4 being attached to the free end of a sled-type leg of the chair and showing a glide being mounted to a head portion thereof.

Referring now to FIGS. 4 and 5, the second furniture-foot assembly 110 will be described. Similar or like parts of the assembly 110 with respect to the assembly 10 have similar or like reference numerals as those of the assembly 10 increased by one hundred (100). The assembly 110 includes, in general, a head portion, generally indicated at 164, defining a bottom exterior portion, generally indicated at 134, of the head portion 164. A stem portion, generally indicated at 166, is attached to and extends from an end of the head portion 164 and is adapted to be removably attached to the free end 28 of the leg 16. A glide, generally indicated at 136, is adapted to be removably mounted to the bottom exterior portion 134 of the head portion 160 and supported upon the floor surface 14 for gliding movement of the assembly 110 relative to the floor surface 14.

More specifically, the head portion 164 is offset from the stem portion 166 so as to define a space 167 between the head portion 164 and stem portion 166. The stem portion 166 is adapted to be matingly received in the free end 28 of the leg 16 such that the head portion 164 is adapted to matingly receive the free end 28 of the leg 16. In particular, an outer diameter of the stem portion 166 is smaller than an inner diameter of each of the head portion 164 and free end 28 of the leg 16. The stem portion 166 extends from the head portion 164. A part of an exterior surface of the stem portion 166 defines a series of substantially uniform ribs 168 that are disposed substantially uniformly about the entirety of the stem portion 166. This part of the stem portion 166 is adapted to be matingly received within the free end 28 of the leg 16.

The bottom exterior portion 134 of the head portion 164 defines a groove 144 into which the glide 136 is adapted to be received to removably mount the glide 136 to the bottom exterior portion 134. In one embodiment, the groove 144 is substantially uniform and hemispherical and outlines an island 146. The groove 144 extends a substantial portion of the perimeter of the bottom exterior portion 134. The bottom exterior portion 134 defines a ledge 148 that circumscribes substantially the entire groove 144 and is adapted to support a portion of the glide 136. A central area of the island 146 defines an orifice 150 into which a portion of the glide 136 is adapted to be received to removably mount the glide 136 to the bottom exterior portion 134. The function of each of the ledge 148 and orifice 150 is described in greater detail immediately below.

The glide 136 has a cap, generally indicated at 152, that is adapted to be received within the groove 144 of the bottom exterior portion 134 of the head portion 164. The cap 152, in turn defines a rib 154 that limits movement of the glide 136 and is received within the groove 144. The cap 152 also defines a nub 156 that extends from the interior surface of the cap 152 and is adapted to be operatively matingly received within the orifice 150 of the bottom exterior portion 134 of the head portion 164 to removably mount the glide 136 to the bottom exterior portion 134. To this end, the nub 156 has a bulbous head that is frictionally retained at the closed end of the orifice 150. The cap 152 defines also a hollow interior 158 that is adapted to operatively receive the island 146 of the bottom exterior portion 134 of the head portion 164.

The glide 136 also includes a pad 160 adapted to be supported upon the floor surface 14 for gliding movement of the glide 136 and, thus, assembly 110 relative to the floor surface 14. In one embodiment, the pad 160 covers the surface of the cap 152 that is disposed opposite the interior 158 of the cap 152. The pad 160 may be made of any suitable material, but in the embodiment disclosed herein, the pad 160 is made of felt or a felt-like material.

The assembly 110 is mechanically fastened to the free end 28 of the leg 16. In particular, an interior surface of the free end 28 of the leg 16 is frictionally engaged with the series of ribs 168 of the stem portion 166 to fasten the assembly 110 to the free end 28 of the leg 16.

It should be appreciated by those having ordinary skill in the related art that the head portion 164 can have any suitable shape, size, and structure. It should also be appreciated that the stem portion 166 can have any suitable shape, size, and structure and structural relationship with the head portion 164 and free end 28 of the leg 16. It should also be appreciated that the glide 136 can have any suitable shape, size, and structure and structural relationship with the head portion 164 and floor surface 14. It should also be appreciated that each of the cap 152 and pad 160 can have any suitable shape, size, and structure and structural relationship with the other. It should also be appreciated that the glide 136 can include any suitable material, such as rubber or nylon, adapted to be supported upon the floor surface 14 for gliding movement of the glide 136 and, thus, assembly 110 relative to the floor surface 14. It should also be appreciated that the assembly 110 can be mechanically fastened to the free end 28 of the leg 16 by any suitable means.

Preferably, each of the body 30, head portion 164, stem portion 166, and cap 52, 152 is made of a hard plastic. However, it should be appreciated by those having ordinary skill in the related art that each of the body 30, head portion 164, stem portion 166, and cap 52, 152 can be made of any suitable material. It should also be appreciated that the pad 60, 160 can be made of any suitable type of material and felt is only one example of it. It should also be appreciated that the glide 36, 136 can include any suitable material adapted to be supported upon the floor surface 14 for gliding movement of the glide 36, 136 and, thus, assembly 10, 110 relative to the floor surface 14.

In operation, an assembly 10 is attached to the elbow 26 of each leg 16 of the chair 12, which is supported upon the floor surface 14. To this end and in connection with each leg 16, the glide 36 is mounted to the bottom exterior portion 34 of the body 30 of the assembly 10. The lowermost portion 24 of the leg 16 of the chair 12 is then raised off the floor surface 14 a sufficient amount to allow the hollow interior 32 of the body 30 to receive the elbow 26 of the leg 16. The elbow 26 is then received within the hollow interior 32. The assembly 10 is then fastened to the elbow 26 by the screw. The lowermost portion 24 of the leg 16 of the chair 12 is then lowered back to the floor surface 14 for gliding movement of the assembly 10 relative to the floor surface 14.

Alternatively or in addition, an assembly 110 is attached to the free end 28 of each leg 16 of the chair 12, which is supported upon the floor surface 14. To this end and in connection with each leg 16, the glide 136 is mounted to the bottom exterior portion 134 of the head portion 164 of the assembly 110. The lowermost portion 24 of the leg 16 of the chair 12 is then raised off the floor surface 14 a sufficient amount to allow the free end 28 of the leg 16 to receive the stem portion 166. In this way, the assembly 110 is fastened to the free end 28 of the leg 16 by frictional engagement between the interior surface of the free end 28 of the leg 16 and exterior surface of the stem portion 166. The lowermost portion 24 of the leg 16 of the chair 12 is then lowered back to the floor surface 14 for gliding movement of the assembly 110 relative to the floor surface 14.

The pad 60, 160 may wear down over time so that the cap 52, 152 may eventually engage the floor surface 14. To avoid the cap 52, 152 from doing this, the glide 36, 136 can be easily removed and replaced with a new glide 36, 136 and, thus, pad 60, 160 without replacing the remainder of the assembly 10, 110, thus avoiding contact of the cap 52, 152 on the floor surface 14.

It should be appreciated by those having ordinary skill in the related art that the assemblies 10, 110 can be attached to the legs 16 of the chair 12 in any suitable order with respect to each other. It should also be appreciated that the glide 36 can be mounted to the bottom exterior portion 34 of the body 30 of the assembly 10 after the elbow 26 of the leg 16 is received within the hollow interior 32 of the body 30 or the assembly 10 is fastened to the elbow 26 by the screw. It should also be appreciated that the glide 136 can be mounted to the bottom exterior portion 134 of the head portion 164 of the assembly 110 after the stem portion 166 of the assembly 110 is received within the free end 28 of the leg 16. It should also be appreciated that the glide 36, 136 can be removed and replaced at any suitable time.

Use of the furniture-foot assembly 10, 110 is a relatively easy, efficient, and inexpensive way of adding a foot to the elbow 26 of the sled-type leg 16. Also, the assembly 10, 110 has the glide 36, 136, which is adapted to be removably mounted to the remainder of the assembly 10, 110 and reduce incidence of floor scraping, scratching, or marring and generation of noise. Furthermore, the bottom exterior portion 34, 134 of the assembly 10, 110 defines relatively less area upon which dirt, dust, sand, and other debris can gather. In addition, the glide 36, 136 is replaceable without replacing the remainder of the assembly 10, 110.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A furniture-foot assembly for a chair that has a sled-type leg, the sled-type leg having a first portion that extends above a supporting surface and a second portion that extends horizontally upon the supporting surface, wherein an elbow portion is defined where the first portion and second portion are joined, the furniture-foot assembly comprising:

a body defining a hollow interior that is assembled over the elbow portion, the body having a bottom exterior portion that extends horizontally from the elbow portion along the length of the second portion of the leg, and an island that protrudes toward the supporting surface is defined by a slot in the body provided on the bottom exterior portion;

a glide that includes a cap and a pad is assembled to the bottom exterior portion of the body with the cap facing the body and the pad facing the supporting surface, the glide is elongated and extends in the direction of the length of the second portion of the leg, the glide has a hollow area defined by a rib on the cap that is inserted into the slot to receive the island on the cap when the glide is assembled to the body.

2. The furniture-foot assembly of claim 1 wherein the glide is rectangular in shape and the slot is rectangular, and wherein the rib extends about the glide.

3. The furniture-foot assembly of claim 1 wherein the bottom exterior portion defines an orifice and the cap has a protrusion that is received in the orifice.

4. The furniture-foot assembly of claim 3 wherein the glide may be disassembled from the body by detaching the island from the hollow area and by removing the protrusion from the orifice, and wherein the glide may be replaced with a different glide without disassembling the body from the elbow portion.

5. A furniture-foot assembly for a chair that has a sled-type leg, the sled-type leg having a first portion that extends above a supporting surface and a second portion that extends horizontally upon the supporting surface, wherein the second portion defines an open end, the furniture-foot assembly comprising:

a head that has a bottom exterior portion that faces downwardly in a vertical direction, an island that protrudes toward the supporting surface is defined by a slot in the body provided on the bottom exterior portion;

a stem portion extending from one side of the head in a horizontal direction, wherein the stem portion is assembled into the open end of the second portion of the sled-type leg that extends horizontally upon the supporting surface;

a glide that includes a cap and a pad that is assembled to the bottom exterior portion of the head with the cap facing the head and the pad facing the supporting surface, wherein the glide is oriented to engage the supporting surface that is perpendicular to the direction in which the second portion of the leg extends, the glide has a hollow area defined by a rib provided on the cap, wherein the hollow area receives the island when the glide is assembled to the body with the rib being inserted into the slot.

6. The furniture-foot assembly of claim 5 wherein the glide has an arcuate edge and a flat edge, wherein the rib provided on the cap extends about the glide, and wherein the slot formed in the bottom exterior portion follows the arcuate edge and flat edge of the glide and receives the rib.

7. The furniture-foot assembly of claim 5 wherein the bottom exterior portion defines an orifice and the cap has a protrusion that is received in the orifice.

8. The furniture-foot assembly of claim 7 wherein the glide may be disassembled from the body by detaching the island from the hollow area and by removing the protrusion from the orifice, and wherein the glide may be replaced with a different glide without disassembling the stem portion from the open end of the second portion of the sled-type leg.

* * * * *